United States Patent [19]

Forsberg

[11] 4,154,670

[45] May 15, 1979

[54] METHOD OF REREFINING OIL BY DILUTION, CLARIFICATION AND EXTRACTION

[75] Inventor: John W. Forsberg, Mentor-on-the-Lake, Ohio

[73] Assignee: The Lubrizol Corporation, Wickliffe, Ohio

[21] Appl. No.: 757,816

[22] Filed: Jan. 10, 1977

Related U.S. Application Data

[63] Continuation-in-part of Ser. No. 634,551, Nov. 24, 1975, abandoned.

[51] Int. Cl.[2] ..... B01D 11/00; C10M 11/00; C10G 21/02

[52] U.S. Cl. ..... 208/180; 208/181; 210/22 R; 210/51; 210/61

[58] Field of Search ..... 208/179, 180, 181; 210/21, 22, 511, 51, 61

[56] References Cited

U.S. PATENT DOCUMENTS

| | | | |
|---|---|---|---|
| 1,281,354 | 10/1918 | Handy | 208/180 |
| 2,605,272 | 8/1952 | Hunn et al. | 210/511 |
| 2,726,986 | 12/1955 | Gross | 210/21 |
| 3,819,508 | 6/1974 | Fainman et al. | 208/180 |
| 3,835,035 | 9/1974 | Fainman | 208/181 |
| 3,919,076 | 11/1975 | Cutler et al. | 208/180 |
| 3,985,642 | 10/1976 | Friel et al. | 208/180 |
| 4,001,109 | 1/1977 | Li et al. | 210/21 |
| 4,021,333 | 5/1977 | Habiby et al. | 208/179 |
| 4,028,226 | 6/1977 | Forsberg | 208/181 |

FOREIGN PATENT DOCUMENTS

| | | | |
|---|---|---|---|
| 2203871 | 5/1974 | France | 210/21 |
| 47-15025 | 7/1969 | Japan | 210/21 |

OTHER PUBLICATIONS

Chem. Abstracts 73:37181 (1970).
Chem. Abstracts 70:69972 (1969).

*Primary Examiner*—Charles N. Hart
*Assistant Examiner*—David R. Sadowski
*Attorney, Agent, or Firm*—James W. Adams, Jr.; William H. Pittman

[57] ABSTRACT

Used oil is rerefined by diluting it with a non-polar diluent, removing insoluble impurities from the resulting solution, extracting said solution with an immiscible liquid extractant to remove further impurities, and finally removing extractant and diluent from the oil.

11 Claims, No Drawings

METHOD OF REREFINING OIL BY DILUTION, CLARIFICATION AND EXTRACTION

This application is a continuation-in-part of copending application Ser. No. 634,551, filed Nov. 24, 1975, now abandoned.

This invention relates to a method of rerefining oil for use in lubricants and the like. More particularly, it relates to a method of recovering oil of lubricating viscosity from used oil which comprises the steps of:

(A) Diluting said used oil with a substantially nonpolar diluent in which said used oil is substantially soluble, and removing insoluble impurities from the solution of said oil in said diluent;

(B) Extracting impurities from the solution of step A with an organic liquid extractant which is substantially immiscible with said solution; and (C) Removing said extractant and diluent from the product of step B.

It is well known that large quantities of petroleum-derived oil are used for the lubrication of machinery of many kinds, including internal combustion engines. Because of the current interest in conservation of petroleum, it is desirable to develop methods for rerefining or reconditioning used oil. Such reconditioning is usually required before reuse since the used oil almost always contains degradation products derived from the oil itself or from additives therein, as well as particles of metal, metal oxides and the like from the engine or other machinery.

A principal object of the present invention, therefore, is to provide a method for rerefining used oil to produce oil capable of further use as a lubricant, fuel or petrochemical intermediate or for similar purposes.

A further object is to provide a rerefining method which is relatively inexpensive and which affords as a product oil roughly comparable in properties to newly refined lubricating oil.

Other objects will in part be obvious and will in part appear hereinafter.

The method of this invention is applicable to any used oil of lubricating viscosity. This includes used crankcase oil from motor vehicles (e.g., cars, trucks, locomotives), automatic transmission fluids and other functional fluids in which the major constituent is an oil of lubricating viscosity, and waste oil from industrial lubrication applications. It may be used with synthetic oils, including synthetic hydrocarbons, halo-substituted hydrocarbons, alkylene oxide polymers and interpolymers and derivatives thereof, ester- or silicon-based oils, and the like. However, its principal utility is with petroleum-based hydrocarbon oils, especially those previously used as industrial lubricants or functional fluids. In the remainder of this specification, the oils referred to will be petroleum-based oils (i.e., mineral oils), but it is to be understood that synthetic oils of the above and similar types may be substituted therefor.

In step A of the method of this invention, the used oil is diluted with a non-polar diluent which is a solvent therefor. Suitable diluents are organic liquids which are substantially inert to the oil and are volatile enough for easy removal by vacuum stripping or the like. For the latter purpose, the diluent will usually have a boiling point at atmospheric pressure no higher than about 150° C. Typical diluents are aliphatic hydrocarbons such as naphtha and hexane. The ratio of diluent to oil is chosen so as to provide optimum separation of insoluble impurities and is typically between about 0.5:1 and 10:1, by weight, with ratios between about 0.5:1 and 3:1 being preferred.

Insoluble impurities are removed from the oil-diluent mixture by methods known per se, such as decantation, centrifugation or filtration, the latter two methods being preferred. The dilution and separation of impurities are ordinarily carried out at temperatures of about 10°–50° C., typically at ambient temperature.

In step B of the method of this invention, remaining impurities are extracted from the solution of step A with an organic liquid extractant which is substantially immiscible therewith. The word "immiscible" as used herein denotes a situation in which two liquids are completely insoluble in each other; that is, in which they form two phases regardless of the proportions in which they are mixed.

Extraction is continued for long enough to remove from the oil-diluent solution substantially all impurities which are soluble in the extractant. The amount of extractant is not critical, particularly in view of the fact that used extractant can be purified (e.g., by distillation) and recirculated. It is frequently convenient to use about 20–50 parts by weight of extractant per 100 parts of the solution of step A, but more extractant can, of course, be used if desired. The. extraction is usually carried out at about 20°–50° C., typically at ambient temperature, and at atmospheric pressure.

The extractant is generally one which is substantially free of water and substantially inert, under the conditions of the extraction, to the solution of step A. A wide variety of liquids, mostly polar liquids, may be used as extractants. They include the following (as well as mixtures thereof):

Ethanol
Diacetone alcohol
Ethylene glycol mono-(lower alkyl) ethers
Diethylene glycol
Diethylene glycol mono-(lower alkyl) ethers
o-Chlorophenol
Furfural
Acetone
Formic acid
4-Butyrolactone
Lower alkyl esters of lower mono- and dicarboxylic acids
Dimethylformamide
2-Pyrrolidone and N-(lower alkyl)-2-pyrrolidones
Epichlorohydrin
Dioxane
Morpholine, lower alkyl and amino-(lower alkyl)-morpholines
Benzonitrile
Di-(lower alkyl) sulfoxides
Di-(lower alkyl) (lower alkyl)phosphonates.

Especially preferred are compounds from the above list which have a boiling point in the range 120°–225° C. at one atmosphere pressure and a specific gravity in the range 0.90–1.05, measured at 20° C. in comparison with water at 4° C. Within this subgroup, a particular preference is expressed for ethylene glycol monomethyl ether, dimethylformamide and N-methyl-2-pyrrolidone.

In step C, the extractant, diluent and impurities are removed from the oil. The greater part of the extractant and impurities can be removed merely be allowing the liquid mixture to separate into two phases, one of which is principally oil and diluent. Sometimes, however, a small amount of extractant is entrained or dissolved in the oil-diluent solution, and in this event it may be removed by evaporation under vacuum or by other suitable means. The removed extractant liquid can be purified (e.g., by distillation) and recirculated for further extraction.

The diluent is generally removed from the oil by vacuum stripping at relatively low temperatures, preferably no higher than about 125° C. During such vacuum stripping or other removal process, volatiles such as fuel dissolved in the oil will also be removed and may be recovered for subsequent use.

The product of step C is sometimes darkly colored and if so, it may be subjected to other treatment steps such as hydrogenation, solvent extraction, treatment with clay or the like. It is suitable for reuse as a lubricant or for use as a bunker fuel, petrochemical intermediate or the like.

The method of this invention is illustrated by a procedure in which 21.7 parts by weight of a used hydraulic oil is diluted with 21.7 parts of hexane and the solution is clarified in a DeLaval centrifuge. The recovery of clarified solution is 35.8 parts.

The clarified solution is treated in a counter-current extractor with 14 parts of ethylene glycol monomethyl ether. There are recovered from the extractor 13.4 parts of ethylene glycol monomethyl ether and 34.75 parts of oil-hexane solution. The hexane and other volatiles are removed from this solution by vacuum stripping at up to 70° C., yielding 19.95 parts of the rerefined oil.

What is claimed is:

1. A method of recovering oil of lubricating viscosity from used oil which comprises the steps of:

(A) Diluting said used oil with a substantially nonpolar diluent in which said used oil is substantially soluble, and removing insoluble impurities from the solution of said oil in said diluent;

(B) Extracting impurities from the solution of step A with an organic liquid extractant which is substantially free from inorganic acids and bases and substantially inert to and immiscible with said solution; and (C) Removing said extractant and diluent from the product of step B.

2. A method according to claim 1 wherein the diluent in step A is an aliphatic hydrocarbon.

3. A method according to claim 2 wherein the diluent in step A is hexane or naphtha.

4. A method according to claim 1 wherein insoluble impurities are removed in step A by centrifugation.

5. A method according to claim 4 wherein the extractant of step B is at least one material selected from the group consisting of:

Ethanol
Diacetone alcohol
Ethylene glycol mono-(lower alkyl) ethers
Diethylene glycol
Diethylene glycol mono-(lower alkyl) ethers
o-Chlorophenol
Furfural
Acetone
Formic acid
4-Butyrolactone
Lower alkyl esters of lower mono- and dicarboxylic acids
Dimethylformamide
2-Pyrrolidone and N-(lower alkyl)-2-pyrrolidones
Epichlorohydrin
Dioxane
Morpholine, lower alkyl and amino-(lower alkyl)morpholines
Benzonitrile
Di-(lower alkyl) sulfoxides
Di-(lower alkyl) (lower alkyl)phosphonates.

6. A method according to claim 5 wherein the extractant of step B has a boiling point at one atmosphere pressure in the range 120°–225° C. and a specific gravity, measured at 20° C. in comparison with water at 4° C., in the range 0.90–1.05.

7. A method according to claim 6 wherein the extractant of step B is ethylene glycol monomethyl ether, dimethylformamide or N-methyl-2-pyrrolidone.

8. A method according to claim 7 wherein the diluent is removed in step C by vacuum stripping.

9. A method according to claim 8 wherein the diluent in step A is an aliphatic hydrocarbon.

10. A method according to claim 9 wherein the diluent in step A is hexane or naphtha.

11. A method according to claim 1 wherein insoluble impurities are removed in step A by filtration.

* * * * *